US009022068B2

(12) United States Patent
Achatz et al.

(10) Patent No.: US 9,022,068 B2
(45) Date of Patent: May 5, 2015

(54) COMPRESSOR ARRANGEMENT WITH BYPASS MEANS FOR PREVENTING FREEZING OF THE COOLING UNIT

(75) Inventors: Christian Achatz, Freising (DE); Klaus-Michael Schneider, Markt Indersdorf (DE); Gerhard Pröll, Garching (DE)

(73) Assignee: Knorr-Bremse Systeme fur Schienenfahrzeuge GmbH, Munich (DE)

( * ) Notice: Subject to any disclaimer, the term of this patent is extended or adjusted under 35 U.S.C. 154(b) by 1492 days.

(21) Appl. No.: 12/093,156

(22) PCT Filed: Nov. 10, 2006

(86) PCT No.: PCT/EP2006/010780

§ 371 (c)(1),
(2), (4) Date: Oct. 29, 2008

(87) PCT Pub. No.: WO2007/054328

PCT Pub. Date: May 18, 2007

(65) Prior Publication Data

US 2009/0151794 A1 Jun. 18, 2009

(30) Foreign Application Priority Data

Nov. 11, 2005 (DE) ..... 10 2005 053 949

(51) Int. Cl.

| | |
|---|---|
| ***F16L 53/00*** | (2006.01) |
| ***F04B 39/06*** | (2006.01) |
| ***F04B 25/00*** | (2006.01) |

(52) U.S. Cl.

CPC ..... *F04B 39/068* (2013.01); *F04B 25/00* (2013.01); *F04B 39/06* (2013.01); *F04B 39/066* (2013.01)

(58) Field of Classification Search

CPC ..... F04B 39/068; F04B 39/066; F04B 25/00; F04B 39/06; B60H 1/00485; C02F 1/686; F16K 11/22; F24D 19/0007; A01C 23/042; F16L 53/00

USPC ..... 137/599.14; 165/62, 103; 417/53, 307, 417/244

See application file for complete search history.

(56) References Cited

U.S. PATENT DOCUMENTS

| | | | | |
|---|---|---|---|---|
| 3,232,340 | A | 2/1966 | Schramm et al. | |
| 5,623,834 | A * | 4/1997 | Bahel et al. | 62/131 |

(Continued)

FOREIGN PATENT DOCUMENTS

| | | |
|---|---|---|
| DE | 3307064 | 9/1984 |
| DE | 19600377 | 6/1997 |

OTHER PUBLICATIONS

George Wentworth et al., "Ratio and Proportion" Fundamentals of practical mathematics, (1922), Ginn and Co. pp. 55ff.*

*Primary Examiner* — Melanie Tyson
*Assistant Examiner* — Chee-Chong Lee
(74) *Attorney, Agent, or Firm* — Barnes & Thornburg LLP

(57) ABSTRACT

Compressor arrangement for generating compressed air using a motor-operator compressor unit, downstream of which at least one cooler unit is connected for cooling the generated compressed air, which enters the cooler unit via at least one inlet, flows there through a cooling structure, from a plurality of cooling passages connected in parallel and leaves the cooler unit via at least one outlet, wherein a permanently open bypass pipe is provided between the region of the inlet and the region of the outlet, the inner cross section of which bypass pipe is matched to the delivery capacity of the compressor unit and to the pressure difference between inlet and outlet such that the bypass pipe, at normal ambient temperatures, causes a higher flow resistance than the cooling structure, whereas, as freezing of the cooling structure progresses, the compressed air flows increasingly via the bypass pipe.

7 Claims, 3 Drawing Sheets

(56) References Cited

U.S. PATENT DOCUMENTS 5,669,363 A * 9/1997 Francis ..... 123/563
6,027,311 A * 2/2000 Hill et al. ..... 417/53
6,167,956 B1 * 1/2001 Bostedo et al. ..... 165/284
6,604,515 B2 * 8/2003 Marsh et al. ..... 123/563
6,952,932 B2 10/2005 Goettel et al.

* cited by examiner

COMPRESSOR ARRANGEMENT WITH BYPASS MEANS FOR PREVENTING FREEZING OF THE COOLING UNIT

This application is a National Phase Application based upon and claiming the benefit of priority to PCT/EP2006/010780, filed on Nov. 10, 2006, based upon and claiming the benefit of priority to German Application 102005053949.1, filed on Nov. 11, 2005 the contents of both of which are incorporated herein by reference.

BACKGROUND AND SUMMARY

The present invention relates to a compressor arrangement for generating compressed air by a motor-driven compressor unit, downstream of which is positioned at least one cooler unit for cooling the generated compressed air. The compressed air enters into the cooler unit via at least one inlet, flows through a cooling structure around which cooling air flows and which is composed of a plurality of parallel cooling ducts, and leaves the cooler unit via at least one outlet. A bypass means is provided between the inlet and the outlet of the cooler unit in order to prevent freezing of the cooler unit at low ambient temperatures.

The field of application of the present invention extends primarily to oil-free piston compressors which are used for generating compressed air for example in the utility vehicle and rail vehicle industry. In such applications, the compressor arrangement must function over a temperature range from −50° C. to +50° C. ambient temperature. Since the cooler design also provides a maximum cooling power at +50° C., it is possible under special ambient conditions—for example 100% air humidity, 20° C. ambient temperature and 50% activation duration—to observe icing up of the cooling ducts within the cooler unit of the compressor arrangement. During the operation of the compressor unit, said icing can, over a time period of several hours, progress to such an extent that a sufficient delivery of air is no longer possible and the compressor arrangement ultimately fails.

U.S. Pat. No. 6,952,932 B2 discloses a cooler unit for a compressor arrangement in which the above-explained problem is solved in that not the entire quantity of compressed air heated by the compressor unit positioned upstream passes through the cooling structure around which cooling air flows. Rather, a part of the heated compressed air is conducted via a bypass line past the cooling structure directly to the outlet, where said compressed air is mixed with the compressed air cooled by the cooling structure. For the mixing, however, a mixing valve inserted into the bypass line is necessary, which mixing valve is actuated according to an electronic controller in order to mix hot compressed air with cooled compressed air according to the ambient temperature.

A disadvantage of said known technical solution is however that the valve and control technology provided here entails a corresponding level of device-related expenditure. In the event of a failure or malfunction of valve or control electronics as a result, for example, of an interruption in the power supply to the control electronics or wear of a seal in the valve, freezing of the cooling unit could progress unhindered to the point of its destruction. Furthermore, said solution is suitable primarily for preventing freezing of the units positioned downstream of the cooler unit.

U.S. Pat. No. 5,669,363 discloses a further technical solution for bypass means on a cooler unit, which however likewise requires extremely complex valve control—in this case by means of a thermostat valve.

It is therefore the object of the present invention to create a compressor arrangement whose at least one cooler unit is effectively prevented from freezing by means of simply-constructed bypass means.

The object is achieved proceeding from a compressor arrangement as follows.

The invention encompasses the technical teaching that merely a permanently open bypass pipe, without any valves situated in the compressed air flow, is provided as a bypass means between the region of the inlet and the region of the outlet of the cooler unit. Here, the inner cross section of the bypass pipe is matched to the delivery capacity of the compressor unit and to the pressure difference between the inlet and the outlet in such a way that the bypass pipe generates a higher flow resistance than the cooling structure at normal ambient temperatures. Normal ambient temperatures refer primarily to temperatures above the freezing point. At temperatures below the freezing point and with progressive freezing of the cooling structure, the compressed air however flows to an increasing extent via the bypass pipe.

The advantage of the solution according to the invention is in particular that, by means of said specially dimensioned bypass pipe, the compressed air generation can be maintained with a minimum loss of cooling and delivery capacity in the event of freezing of the cooler unit. Since the invention gets by entirely without valves, it can be implemented with a conceivably low amount of technical expenditure. The solution according to the invention has an automatic regulating action based on the dimensioning of the bypass pipe. Here, the bypass pipe is to be designed such that the outlet temperature (measured downstream of the cooler unit) is limited such that the function of devices positioned downstream—such as air driers, regulating valves—is not adversely affected.

Tests have shown that, in the case in particular of oil-free piston compressors for the rail vehicle industry, the optimum ratio of inner cross section of the bypass pipe to delivery capacity at 10 bar operating pressure is in the range between 0.8 and 1.2. In the event of a compressor arrangement having a plurality of cooler units, said characteristic variable applies only to the post-cooler. The dimensional units for the inner cross section of the bypass pipe is $mm^2$. The dimensional units for the delivery capacity is l/min.

The bypass pipe according to the invention is preferably to be designed, in order to obtain an optimum function, such that in the event of a frozen cooler unit which no longer allows compressed air to pass through, the pressure difference between the two ends of the bypass pipe rises to a maximum of 0.5 bar. A pressure drop of said type is by all means acceptable as a minimal loss of delivery capacity. By the solution according to the invention, in the case of a completely frozen-up cooler unit, the delivery capacity falls by no more than 5% and the outlet temperature downstream of the cooler unit rises by no more than 20° C. in relation to the cooler without a bypass.

According to a further measure which improves the invention, it is provided that the bypass pipe has screw connections at both ends, by means of which screw connections a detachable fastening of the bypass pipe to the cooler unit can take place. By means of said measure, it is also possible to produce cooler units without a bypass pipe as a further product variant. It is also conceivable for the bypass pipe to be integrated entirely into the cooler unit, for example by being soldered or welded in. A pipe composed of steel or a light metal is suitable for the bypass pipe itself, for which purpose it is possible to resort to a standard semi-finished part, for example a pipe with the basic dimensions of 10×1.5 mm. In the selection and dimensioning of the bypass pipe, it is also to be ensured that the latter can withstand the required test pressure.

It is also possible for the bypass pipe to be provided with cooling plates or cooling fins or to be embodied in the manner of a finned pipe in order to improve the cooling action if required. The bypass pipe can be embodied as or can comprise a hollow body produced by casting. In addition to steel, non-metallic materials are also conceivable for production if these are sufficiently temperature-resistant and pressure-resistant. It is for example also conceivable for the bypass pipe to be embodied as or to contain a hose line.

According to another measure which improves the invention, it is provided that the bypass pipe is arranged relative to the cooler unit such that said bypass pipe is situated in the flow of the cooling air which flows through the cooler unit. In this way, it is ensured that the bypass pipe imparts a minimum cooling action to the compressed air flowing through. The bypass pipe can be arranged either vertically or horizontally in relation to the cooler unit and can run straight. If the actual cooling action of the bypass pipe is not sufficient in the case of a straight profile, the bypass pipe can alternatively also be embodied in the manner of a hose pipe or the like.

It is also conceivable for a dewatering/drain valve or a safety valve to be inserted into the wall of the bypass pipe if this is expedient. A dewatering valve would be arranged at the lowest point of the bypass pipe.

The solution according to the invention is suitable for use both with single-stage and also with multi-stage compressor units. In the case of a single-stage compressor unit, the cooler unit is provided as a post-cooler which can then be fitted with at least one bypass pipe according to the invention. In the case of a multi-stage compressor unit, it is conventional for each individual compressor stage to be provided with a cooler unit positioned downstream in the form of an intermediate or post-cooler, with each cooling unit being assigned at least one bypass pipe.

Regardless of the physical embodiment of the compressor unit, the at least one associated bypass pipe is however preferably designed such that, even in the event of the cooler unit being completely frozen up, the entire delivery capacity of the compressor unit positioned upstream can be conducted via the at least one associated bypass pipe.

Further measures which improve the invention are illustrated in more detail below, together with the description of a preferred exemplary embodiment of the invention, on the basis of the figures, in which:

DETAILED DESCRIPTION OF THE EMBODIMENT

Figure 1:
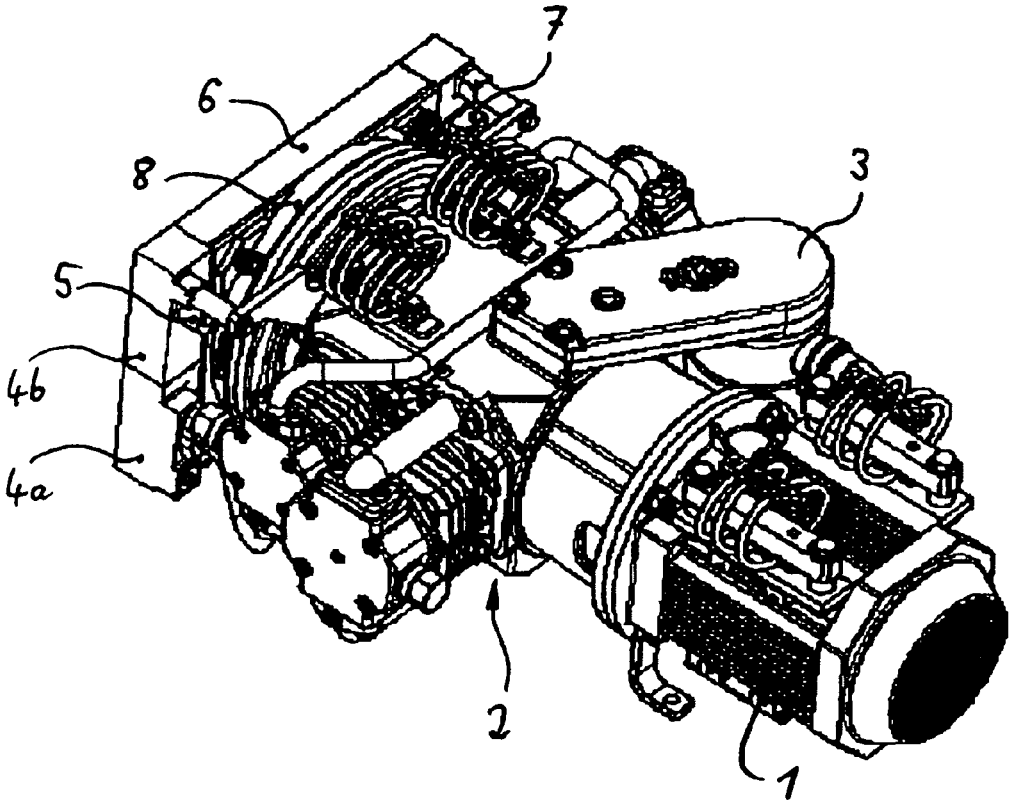
FIG. 1 shows a perspective outer view of a compressor arrangement.

As per FIG. 1, a compressor arrangement is composed of a multi-stage compressor unit 2, which is driven by an electric motor 1, for generating compressed air. For this purpose, air is sucked from the environment via a filter unit 3. Each compressor stage of the compressor unit 2 is assigned a separate cooler unit 4*a* and 4*b*, which serve to cool the compressed air generated in the respective upstream compressor stage. In this respect, the cooler unit 4*a* positioned downstream of a first compressor stage is to be denoted as an intermediate cooler and the cooler unit 4*b* positioned downstream of a second compressor stage of the compressor unit 2 is to be referred to as a post-cooler. Each cooler unit 4*a* and 4*b* has an inlet 5 for inflowing heated compressed air. From here, the heated compressed air passes, in order to be cooled, via a cooling structure 6 around which cooling air flows, which—in a manner known per se—flows out of a plurality of parallel cooling ducts of relatively small diameter, in order to leave the cooler unit 4*a* or 4*b* again via an outlet 7. The cooling air for flowing around the cooling structure 6 is generated by means of a motor-driven or shaft-driven fan wheel 8 which is arranged between the cooler units 4*a* and 4*b* and the compressor unit 2.

Figure 2:
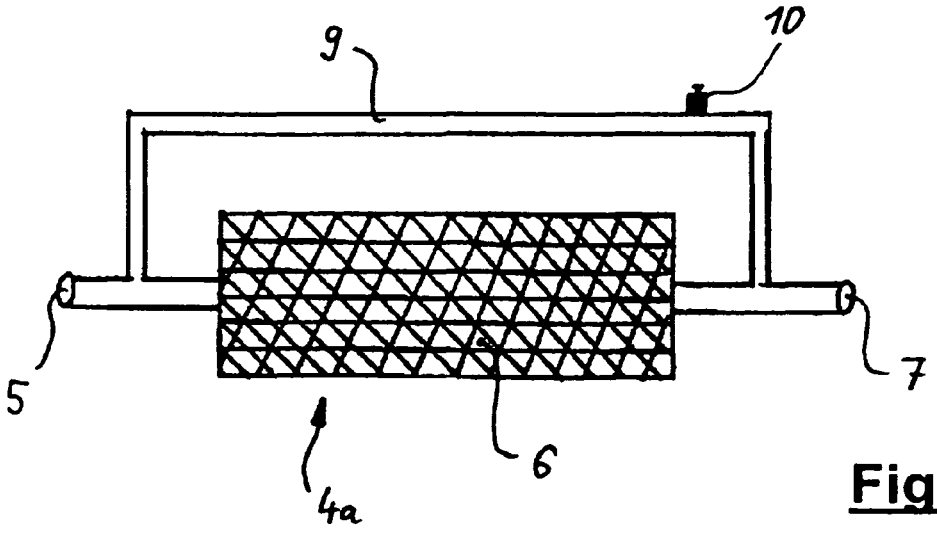
FIG. 2 shows a schematic illustration of bypass means on the cooler unit of the compressor arrangement as per FIG. 1.

According to FIG. 2, the cooler unit 4*a* illustrated here by way of example has, between the inlet 5 and the outlet 7, a bypass pipe 9 for preventing freezing of the cooler unit 4*a* at low ambient temperatures.

The continuous, permanently open bypass pipe 9 is characterized by an inner cross section which is matched to the delivery capacity of the compressor unit 2 and to the pressure difference between the inlet 5 and the outlet 7 in such a way that the bypass pipe 9 generates a higher flow resistance than the cooling structure 6 at normal ambient temperatures, whereas with progressive freezing of the cooling structure 6 as a result of crystal agglomeration on the wall and inner plates, the compressed air flows to an increasing extent via the bypass pipe 9. It has been found that the bypass pipe 9 itself does not freeze under these conditions, since it is heated efficiently by the compressed air itself and by its flow friction in the bypass pipe 9.

The compressed air generation is therefore maintained with the minimum loss of cooling and delivery capacity.

The bypass pipe 9 is designed here as a horizontal straight pipe line which is situated in the flow of the cooling air which flows through the cooler unit 4*a* in order to also cool the bypass pipe 9. In addition, in this exemplary embodiment, a safety valve 10 is inserted into the wall of the bypass pipe 9, which safety valve 10 opens above a defined pressure value in order to prevent rupturing of the bypass pipe 9. Furthermore, in the interior, the bypass pipe 9 can also have surface variations and cross-sectional variations in order to generate a nozzle function if this is expedient in terms of flow dynamics.

Tests have shown that, in the case in particular of oil-free piston compressors for the rail vehicle industry, the optimum ratio of inner cross section of the bypass pipe to delivery capacity at 10 bar operating pressure is in the range between 0.8 and 1.2. In the event of a compressor arrangement having a plurality of cooler units, said characteristic variable applies only to the post-cooler. The dimensional units for the inner cross section of the bypass pipe is =2. The dimensional units for the delivery capacity is l/min.

The bypass pipe according to the invention is preferably to be designed, in order to obtain an optimum function, such that in the event of a frozen cooler unit which no longer allows compressed air to pass through, the pressure difference between the two ends of the bypass pipe rises to a maximum of 0.5 bar. A pressure drop of said type is by all means acceptable as a minimal loss of delivery capacity. By the solution according to the invention, in the case of a completely frozen-up cooler unit, the delivery capacity falls by no more than 5% and the outlet temperature downstream of the cooler unit rises by no more than 20° C. in relation to the cooler without a bypass.

Figure 3:
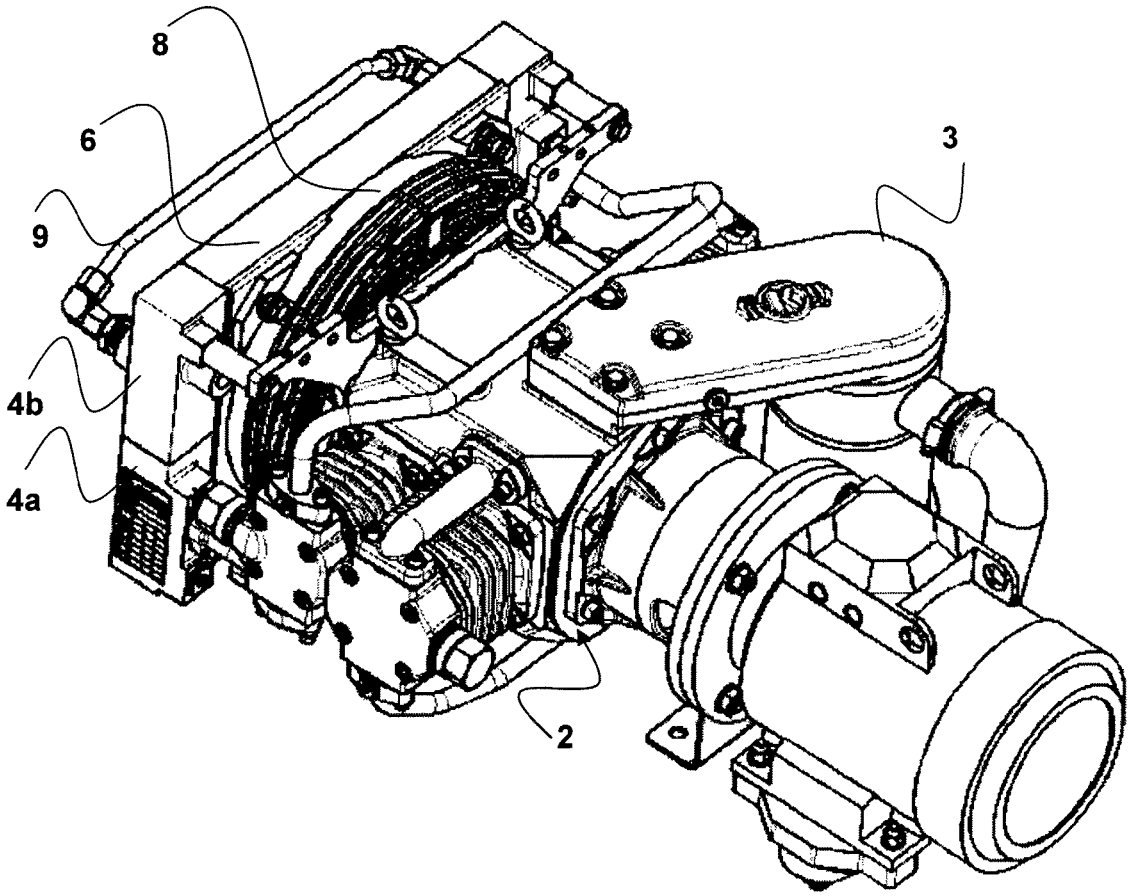
FIG. 3 shows a perspective outer view of another compressor arrangement according to an embodiment of the invention.

According to a further measure which improves the invention, it is provided that the bypass pipe has screw connections at both ends, by means of which screw connections a detachable fastening of the bypass pipe to the cooler unit can take place (see FIG. 3, in which the bypass pipe 9 is provided on the outside of the cooling structure as in FIG. 2). By means of said measure, it is also possible to produce cooler units without a bypass pipe as a further product variant. It is also conceivable for the bypass pipe 9 to be integrated entirely into the cooler unit, for example by being soldered or welded in. A pipe composed of steel or a light metal is suitable for the bypass pipe itself, for which purpose it is possible to resort to a standard semi-finished part, for example a pipe with the basic dimensions of 10.times.1.5 mm. In the selection and dimensioning of the bypass pipe, it is also to be ensured that the latter can withstand the required test pressure. As indicated above, the bypass pipe 9 may be located on the outside or the inside of the cooling structure 6; however, in both circumstances, the bypass pipe 9 is arranged relative to the cooler unit such that the bypass pipe is situated in the flow of the cooling air which flows through the cooler unit.

Figure 4:
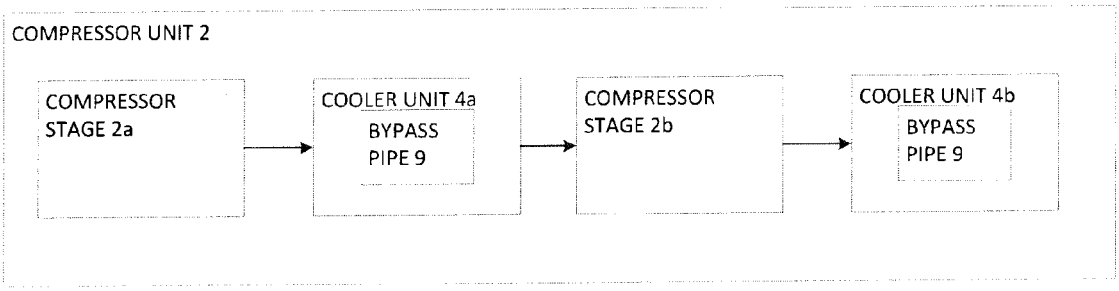
FIG. 4 shows is a block diagram illustrating a multi-stage compressor unit 2, wherein each compressor stage 2*a*, 2*b* of the compressor unit 2 is assigned a separate cooler unit 4*a* and 4*b*, which serve to cool the compressed air generated in the respective upstream compressor stage, wherein each of the cooler units 4*a*, 4*b*, there is provided a bypass pipe 9.

As per FIG. 4, a compressor arrangement is composed of a multi-stage compressor unit 2, wherein each compressor stage 2*a*, 2*b* of the compressor unit 2 is assigned a separate cooler unit 4*a* and 4*b*, which serve to cool the compressed air generated in the respective upstream compressor stage (2*a*, 2*b* respectively). As shown in FIG. 4, for each of the cooler units 4*a*, 4*b*, there is provided a bypass pipe 9.

Although the present invention has been described and illustrated in detail, it is to be clearly understood that the same is by way of illustration and example only, and is not to be taken by way of limitation. The scope of the present invention is to be limited only by the terms of the appended claims.

The invention claimed is:

1. A compressor arrangement comprising:

a motor-driven compressor unit;

at least one cooler unit located downstream of the motor-driven compressor unit and being configured to cool compressed air generated by the motor-driven compressor unit, wherein the generated compressed air enters into the at least one cooler unit via at least one inlet, flows through a cooling structure included in the at least one cooler unit and around which cooling air flows, and leaves the at least one cooler unit via at least one outlet, and a permanently open bypass pipe provided between a region of the at least one inlet and a region of the at least one outlet, an inner cross section of the bypass pipe being matched to a delivery capacity of the motor-driven compressor unit and to a pressure difference between the at least one inlet and the at least one outlet in such a way that the bypass pipe generates a higher flow resistance than the cooling structure at normal ambient temperatures, whereas, with progressive freezing of the cooling structure, the generated compressed air flows to an increasing extent via the bypass pipe to maintain the compressed air generation with a minimum loss of cooling and delivery capacity, a wall of the bypass pipe consisting of at least one dewatering and/or safety valve, wherein, the bypass pipe is arranged relative to the at least one cooler such that the bypass pipe is situated in a flow path of the cooling air which flows through the at least one cooler unit, wherein the inner cross sectional dimension of the bypass pipe is selected so as to provide automatic regulating action based on dimensioning of the bypass pipe such that, in the event of a freezing of the at least one cooler unit which no longer allows compressed air to pass through, a pressure difference between the two ends of the bypass pipe rises to a maximum of 0.5 bar, wherein the bypass pipe does not freeze under conditions that freeze the at least one cooler unit because the bypass pipe is heated by the compressed air itself and by flow friction in the bypass pipe, and wherein the motor-driven compressor unit is of multi-stage construction including multiple compressor stages, wherein the compressor arrangement includes a plurality of cooler units of which the at least one cooler unit is one cooler unit of the plurality of cooler units, wherein each cooler unit in the plurality of cooler units is positioned downstream of a corresponding compressor stage of the multiple compressor stages, with each of the plurality of cooler units including at least one bypass pipe configured to operate in the same manner relative to its corresponding compressor stage as the bypass pipe is configured to operate in the at least one cooler unit.

2. The compressor arrangement as claimed in claim 1, wherein the bypass pipe is detachably fastened to the at least one cooling unit.

3. The compressor arrangement as claimed in claim 1, wherein the bypass pipe is either a vertically or horizontally aligned straight pipe line or a hose pipe.

4. The compressor arrangement as claimed in claim 1, wherein, when the at least one cooler unit is completely frozen up, the entire delivery capacity of the compressor unit positioned upstream is conducted via the associated bypass pipe, and wherein, when the freezing up is eliminated, an initial state before the freezing is automatically re-established.

5. The compressor arrangement as claimed in claim 1, wherein the bypass pipe is integrated into the at least one cooler unit.

6. The compressor arrangement as claimed in claim 1, wherein the bypass pipe is produced by casting.

7. The compressor arrangement as claimed in claim 1, wherein, the bypass pipe is configured to generate a nozzle function.

* * * * *